United States Patent [19]

Torbeck

[11] 4,248,457

[45] Feb. 3, 1981

[54] BONDING STRUCTURE FOR MANIFOLD ASSEMBLIES

[76] Inventor: Frank W. Torbeck, 8529 Concord Hills Circle, Cincinnati, Ohio 45243

[21] Appl. No.: 963,303

[22] Filed: Nov. 24, 1978

[51] Int. Cl.[3] ..... B41L 5/04

[52] U.S. Cl. ..... 282/7; 156/305

[58] Field of Search ..... 282/7, 15 B, 16 B, 21 D, 282/9 R, DIG. 2; 156/291, 305, 309; 11/1 AD

[56] References Cited

U.S. PATENT DOCUMENTS

| | | | |
|---|---|---|---|
| 2,263,435 | 11/1941 | Brenn | 282/DIG. 2 |
| 2,930,632 | 3/1960 | Winders, Jr. et al. | 156/305 X |
| 3,149,859 | 9/1964 | Otis et al. | 282/11.5 A |
| 3,320,109 | 5/1967 | Braner | 156/309 X |
| 3,551,248 | 12/1970 | Blair | 156/305 |
| 3,806,165 | 4/1974 | Skees | 282/11.5 A |
| 4,092,925 | 6/1978 | Fromson | 156/291 X |
| 4,106,148 | 8/1978 | Axelrod | 11/1 AD |

FOREIGN PATENT DOCUMENTS

| | | | |
|---|---|---|---|
| 2325937 | 5/1973 | Fed. Rep. of Germany | 11/1 AD |

*Primary Examiner*—Paul A. Bell

*Attorney, Agent, or Firm*—Walter S. Murray

[57] ABSTRACT

This invention relates to the art of manifolding and collating and is more particularly directed to an improved arrangement for adhesively securing together a plurality of superimposed sheets.

6 Claims, 9 Drawing Figures

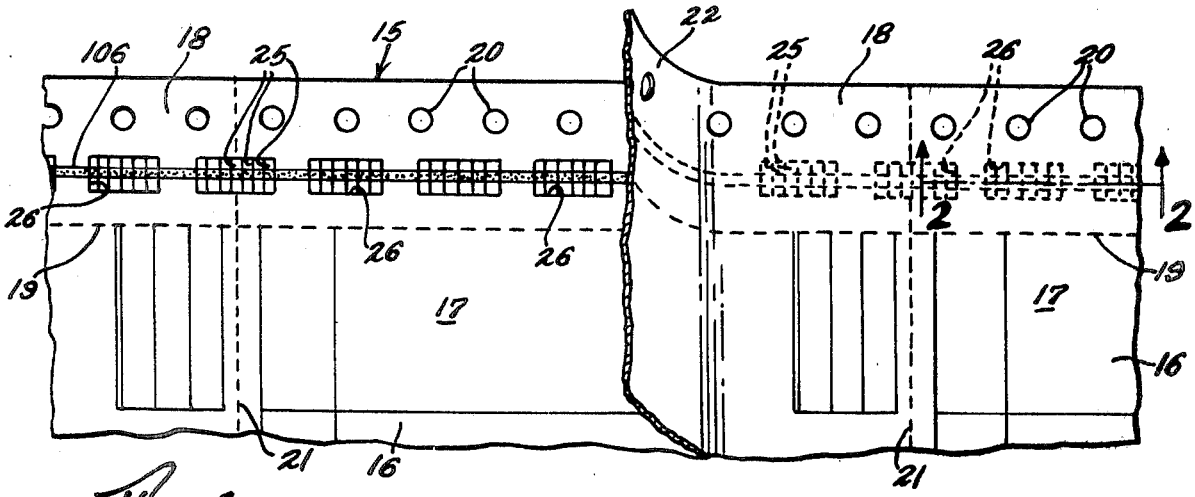
Fig. 1
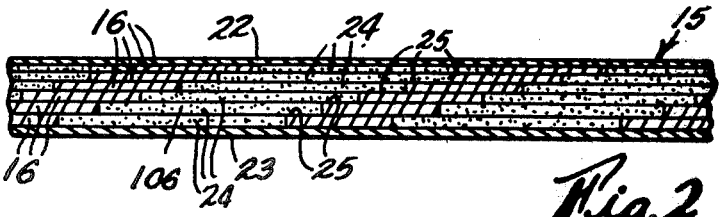
Fig. 2
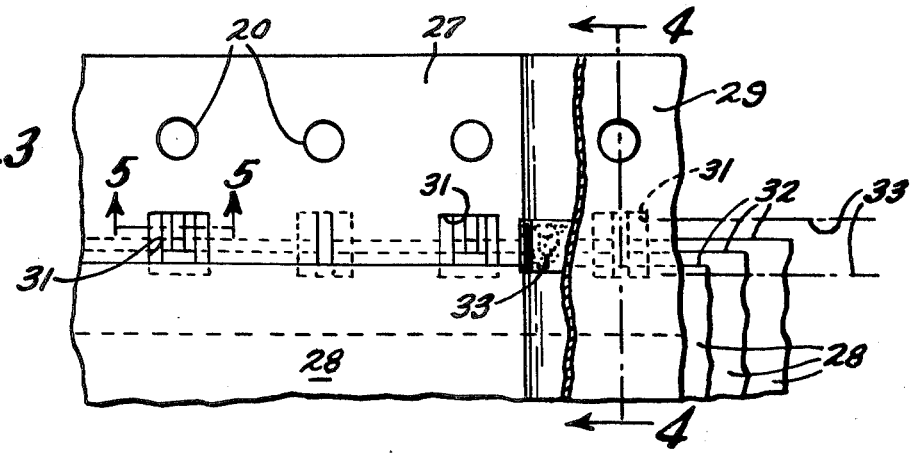
Fig. 3
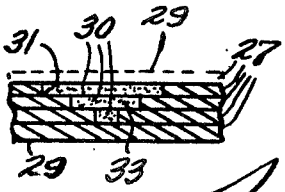
Fig. 5
Fig. 4
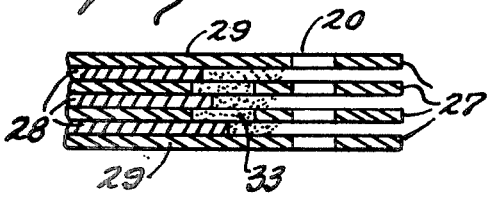

BONDING STRUCTURE FOR MANIFOLD ASSEMBLIES

It is an object of the invention to provide an assembly of superimposed sheets wherein all the sheets are secured together at their common margins by a minimum number of adhesive lines. The assembled sheets may be either carbonless business forms or forms interleaved with transfer sheets, and in either case the number of adhesive applicator stations for collating equipment is minimized and a considerable saving in the amount of adhesive required to effect improved bonding of all the sheets in the manifold assembly is attained.

My improved manifold assembly is directed to marginal securement of the superimposed sheets wherein a longitudinal row of spaced, registered holes are formed in the margins of the sheets and the holes progressively offset in the margins to expose a portion of each sheet around each hole, such disposition of holes forming a number of stepped adhesive receiving openings which bind the margins of the sheets together in the assembly.

Other objects of the invention are to reduce the thickness of manifold assemblies along their adhesive bonded margins whereby the assembly is made more flexible for use in platen type manifold machines; to present a structure that may use tough, high viscosity, rapid setting hot melts as the bonding adhesive; and to provide zig-zag folded business forms with limited amounts of material and adhesive at their fold lines which presently causes uneven stacking and tenting of conventional manifold business forms.

The novel features of this invention are set forth with particularity in the appended claims. The invention will best be understood from the following description read in conjunction with the accompanying drawings, wherein:

FIG. 1 is a fragmental, top plan view of a manifold assembly embodying my invention, an outer sheet thereof being folded back and shown in section.

FIG. 2 is a greatly enlarged section taken on line 2—2 of FIG. 1 with the outer sheet shown bonded to the assembly.

FIG. 3 is a fragmental, top plan view like FIG. 1 showing a modification on my invention.

FIGS. 4 and 5 are enlarged sections taken on lines 4—4 and 5—5, respectively, of FIG. 3.

Figure 6:
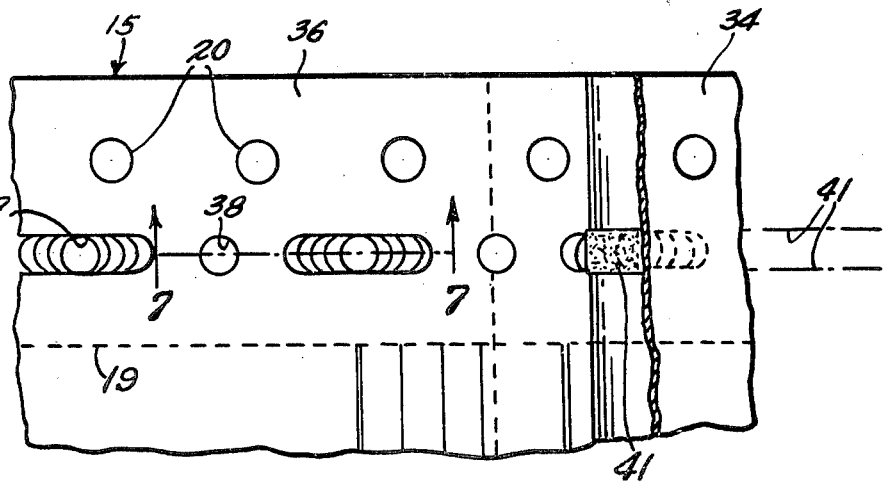

FIG. 6 is a fragmental, top plan view showing another modification of my invention.

Figure 7:
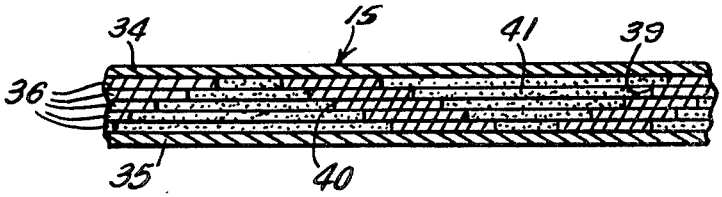

FIG. 7 is an enlarged section taken on line 7—7 of FIG. 6.

Figure 8:
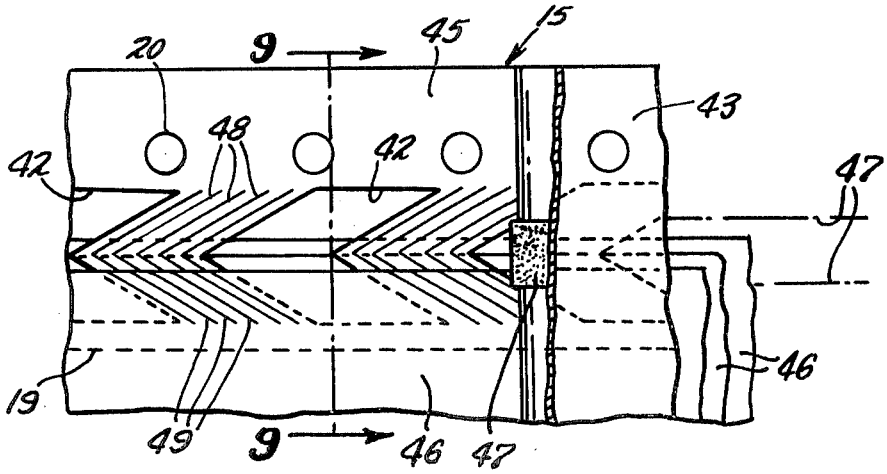

FIG. 8 is a fragmental, top plan view of a further modification of my invention.

Figure 9:
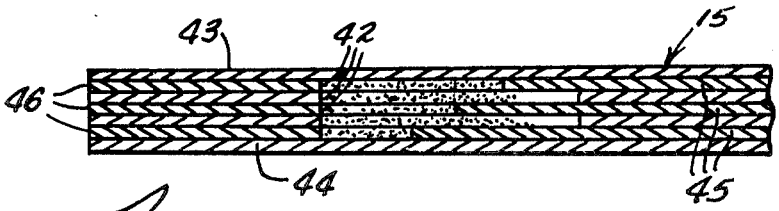

FIG. 9 is an enlarged section taken on line 9—9 of FIG. 8.

With reference to FIGS. 1 and 2 of the drawings, the numeral 15 represents a conventional manifold assembly comprising a number of superimposed sheets 16, each sheet having a record portion 17 and a margin 18 connected to the record portion by a weakened tear line 19. The margins of the sheets are provided with the usual longitudinal series of pinwheel receiving holes 20 which maintain the sheets in registry during collating and manifolding of the assembly and during its ultimate use as business forms. Transverse weakening tear lines 21 are formed in the sheets to divide them into separable business forms, as required. However, my invention, disclosed and claimed herein, is not only concerned with business forms but may be applied to collating and manifolding generally as employed in the binding of tablet sheets, checks, calendars, and in book binding.

The manifold assembly 15 has outer sheets 22 and 23 and it will be noted with reference to FIG. 2 that the margins of said outer sheets 22 and 23 are imperforate between the tear line 19 and the pinwheel holes 20 and that in this marginal area all the intermediate or remaining sheets are each formed with a longitudinal series of spaced apart holes 24. With reference to FIG. 2, it will be noted that the holes 24 are identically shaped and are progressively offset longitudinally to expose a flat surface portion 25 of each sheet adjacent each hole in confrontation with an outer sheet 22 of the assembly. The offset configuration of the holes forms a number of stepped openings 26 in the assembly which receive a single line 106 of adhesive applied longitudinally across all the openings 25, the outer sheet 22 being pressed down upon the line to bind all the intermediate sheets together and to bind together the said outer sheets 22 and 23 through the openings.

It will be seen that removal of material to provide the registered offset holes in the margins of the manifold greatly reduces the thickness of material along the adhesive line thus securing a manifold assembly that will stack evenly and have improved flexibility when used with platen type business machines. The bonded margins are further reduced in thickness by closely spacing the openings 26 such that adjacent openings undercut one another as will be understood from FIG. 2 of the drawings. To provide a stronger bonded assembly an additional line of adhesive may be applied to the inner surface of the outer sheet 23 in registry with the adhesive line 106.

The modification of my invention, depicted in FIGS. 3, 4 and 5 of the drawings, includes a manifold assembly which may comprise form sheets 27 and interleaved transfer sheets 28, the margins of the form sheets having registered holes 30 (FIG. 5) which decrease in longitudinal extent away from the outer sheet 29 to form tapered adhesive receiving openings 31 in the assembly. The transfer sheets have marginal edges 32 which are offset laterally in a progressive manner during collating thus exposing portions of their marginal edges stepwise within the tapering openings 31 whereby adhesive, when applied along a line 33, will bind together the exposed edges of the transfer sheets, the tapered openings in the form sheets and the outer sheets 29—29.

Referring now to FIGS. 6 and 7 of the drawings, the manifold assembly has imperforate margins on its outer sheets 34 and 35, while the margins of the substrate sheets 36 are each provided with alternate long and short holes 37 and 38, respectively, spaced longitudinally in registry in their respective margins and which increase in longitudinal extent outwardly from the short holes. As shown in FIG. 7 of the drawings, this configuration of registered holes results in a series of conically shaped adhesive receiving holes 39 and 40 faced in alternating directions and forming exposed portions on each substrate that face the outer sheets 34 and 35, whereby all the substrates are bonded together and to the outer sheets when a single, narrow line of adhesive, indicated by the dot-and-dash lines 41, is applied to the assembled substrates and the outer sheets 34 and 35 are pressed against them.

Further, my invention contemplates the use of various shaped, adhesive receiving holes that could be advantageously formed in the substrate margins of the sheets and with reference to FIG. 8 the adhesive receiving holes 42 are chevron-shaped and disposed in registry and spaced longitudinally in the margins of the manifold assembly. As best shown in FIG. 9 of the drawings, this modification includes outer sheets 43 and 44 that have imperforate margins and may be considered business form sheets along with substrate sheets 45. Interleaved between the form sheets are transfer sheets 45, the marginal edges of the transfer sheets being offset laterally to expose a portion of each transfer sheet margin to the outer sheet within the holes 42. A line of adhesive, indicated by the dot-and-dash lines 47, is applied only to the apex portions of each chevron shaped hole 42 and to the exposed marginal portions of the transfer sheets whereby only such portions are adhered to the outer sheets whereby a bonded flexibility is provided for the assembly especially when the manifold is to be passed around platens, or the like, in use. To provide greater flexibility to the bonded margins of this assembly the material of the substrate form sheets 45 between the chevron-shaped holes 42 are provided with stress relief slits 48 and the marginal portions of the transfer sheets 46 are likewise provided with stress relief slits 49.

What is claimed is:

1. In a manifold assembly comprising a series of superimposed sheets each sheet having a margin to maintain the sheets in registry, the combination of an outer sheet having an imperforate margin, intermediate sheets each having a row of longitudinally spaced holes formed in the margin, the holes in the margins of the intermediate sheets being in registry and progressively offset longitudinally to expose (a) flat surface portion of each intermediate sheet adjacent each hole to the imperforate margin of the outer sheet and form a number of stepped, adhesive receiving openings in the margins of said intermediate sheets, and a line of adhesive entered into said openings and in contact with the margin of the outer sheet and bonding the assembly together along the margins of all the superimposed sheets.

2. In a manifold assembly set forth in claim 1 wherein the holes in the margins of the remaining sheets have identical shapes and are equally spaced apart in the margins of such sheets.

3. In a manifold assembly set forth in claim 2 wherein an outer sheet is disposed on the front and back sides of the assembly.

4. In a manifold assembly set forth in claim 3 wherein the holes in the margins of the remaining sheets decrease in longitudinal extent in a direction away from the outer sheet.

5. In a manifold assembly set forth in claim 1 wherein transfer sheets are interleaved between remaining sheets, the marginal edges of the transfer sheets being stepped laterally of the assembly whereby the single line of adhesive entered into the openings bonds the transfer sheets to the margins of the outer sheet and the remaining sheets.

6. In a manifold assembly set forth in claim 5 wherein the remaining sheets are business forms.

* * * * *